350-334 SR
PTH52 XR 4,165,607

United States Patent [19]

Fedorowicz et al.

[11] 4,165,607

[45] Aug. 28, 1979

[54] WATCH MODULE

[75] Inventors: Richard J. Fedorowicz; William P. Cegles, both of Chicago, Ill.

[73] Assignee: Motorola, Inc., Schaumburg, Ill.

[21] Appl. No.: 763,488

[22] Filed: Jan. 28, 1977

[51] Int. Cl.[2] ..... G04C 3/00; G04C 17/00

[52] U.S. Cl. ..... 58/50 R; 58/23 BA; 58/23 V

[58] Field of Search ..... 58/23 R, 23 BA, 23 TF, 58/23 V, 50 R, 88 R, 90 R

[56] References Cited

U.S. PATENT DOCUMENTS

| | | | |
|---|---|---|---|
| 3,917,966 | 11/1975 | Mizutani et al. | 58/23 V |
| 3,968,640 | 7/1976 | Clemmer et al. | 58/50 R |
| 3,986,334 | 10/1976 | Harper | 58/50 R |
| 3,986,335 | 10/1976 | Harper | 58/50 R |
| 4,041,213 | 8/1977 | Schneider | 58/23 BA X |
| 4,044,542 | 8/1977 | Burke | 58/23 R |
| 4,045,953 | 9/1977 | Miyazaki | 58/23 R |
| 4,068,464 | 1/1978 | Barnett et al. | 58/50 R |

*Primary Examiner*—Stanley J. Witkowski
*Attorney, Agent, or Firm*—James W. Gillman; Victor Myer

[57] ABSTRACT

An improved electronic watch module structure includes a chassis member having an egg-crate configuration. A substrate having electronic watch components and conductors mounted thereupon has a piezoelectric crystal elememt mounted on it. The substrate is contained by the chassis member. A portion projecting from one of the side walls of the chassis contains a cavity, and the cavity and a portion of the substrate integrally form a hermetically sealed chamber for the piezoelectric crystal element.

5 Claims, 4 Drawing Figures

WATCH MODULE

BACKGROUND OF THE INVENTION

1. Field of the Invention.

This invention relates in general to electronic watch modules and, more particularly, to an improved watch module assembly having a chassis for mounting a substrate and wherein the chassis and substrate cooperate to integrally form a chamber for hermetically sealing an associated crystal element.

2. Description of the Prior Art

Electronic watches of various configurations are well-known in the prior art and in fact have proliferated extensively in recent years. In comparison with their prior mechanical counter parts, electronic watches have usually exhibited a higher profile (height) and attempts have been made to style the watch cases so as to minimize this somewhat undesirable characteristic. Current electronic watch modules generally employ a substrate which is either a ceramic wafer or a printed circuit board containing associated electronic circuitry, which is often secured to a frame member with screws or other fasteners. The frame member supports other watch components as well, such as a visual display of some sort and one or more batteries in, more often than not, in a somewhat awkward, space consuming configurations. The resultant product has a thick, bulky appearance.

In addition, a piezoelectric watch crystal element is usually mounted and sealed in a discrete enclosure, such as a metal can which requires both the crystal before packaging, and the oscillator circuit after assembly, to be trimmed to a predetermined frequency, often times requiring an external variable trimmer capacitor element of relatively large bulk. Current crystal element packages require two leads to extend out of the package and be connected to the oscillator circuitry, requiring a larger overall package size.

SUMMARY OF THE INVENTION

It is, therefore, an object of this invention to provide an improved integrated electronic watch module.

A more particular object of this invention is to provide a watch module of the foregoing type which exhibits a low profile.

Another object of this invention is to provide a thin wall chassis member forming a part of the watch module which may support a substrate containing various electronic watch components.

Still another object of this invention is to provide a chassis member of the foregoing type which includes a cavity therein for cooperating with the substrate so as to form a hermetically sealed chamber for an associated crystal element.

Yet another object of the invention is to provide a hermetically sealed chamber formed from the chassis member and the substrate which nevertheless permits access to the crystal element such as by laser trimming.

Another object of the invention is to provide a crystal element which is connected directly to the electronic watch module substrate.

It is another object of the invention to provide a low profile, high density chassis for locating and holding an electronic watch display module, a watch module battery and switch means connecting said watch module circuits to switch actuating mechanisms.

In practicing this invention, an improved watch module structure is provided which includes a chassis member of an essentially egg-crate configuration, of upstanding peripheral walls and which contains a central aperture. The chassis member further includes a portion extending inwardly from one of the walls and containing a cavity. A substrate is provided which is adapted to be contained within the chassis member and which supports associated electronic watch components and conductors, in operative relation thereon, including a piezoelectric crystal element mounted directly to the substrate. Means are provided for affixing the substrate to the chassis so that the substrate and the cavity contained in the chassis integrally form a hermetically sealed chamber for the crystal element. Further means are contained on the chassis member for holding a watch battery, a watch display means, and switch means connectable to external mechanical actuators, providing a high packing density electronic watch module configuration.

BRIEF DESCRIPTION OF THE DRAWINGS

For a more complete understanding of the invention, reference is made to the drawings in which.

DESCRIPTION OF PREFERRED EMBODIMENT

Figure 1:
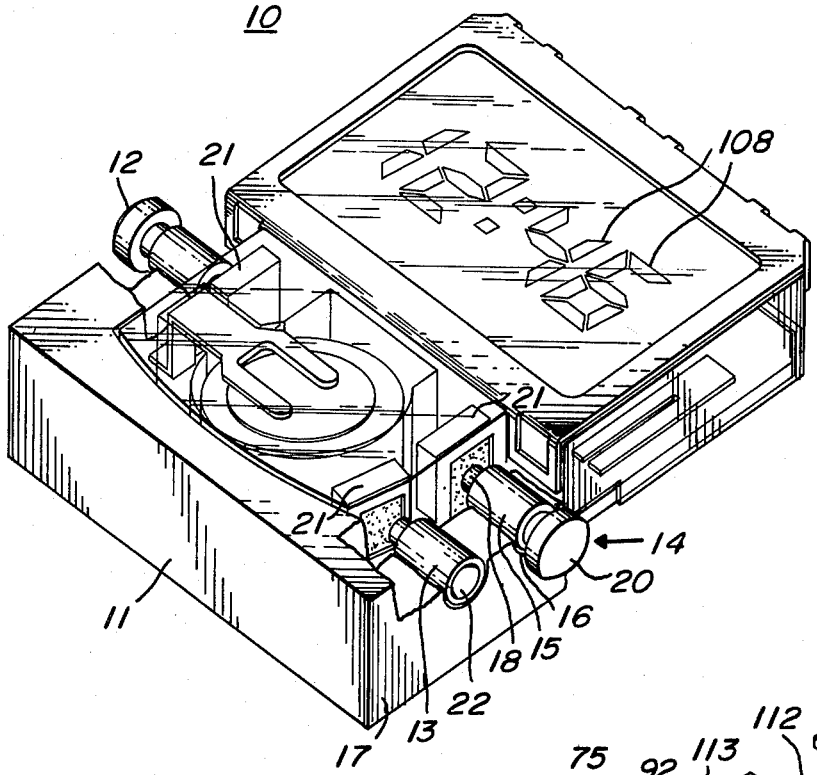
FIG. 1 is a perspective view of an assembled electronic watch module constructed in accordance with the present invention with a partial cut-away view of the watch case.

Referring to FIG. 1, an electronic watch module assembly 10 is shown interfacing with a portion of an associated watch case 11. A portion of the watch case 11 is shown partially cut-away, exposing a first contact switch 12, which may be of any known construction, a second contact switch 13, and a third contact switch 14. A tubular outer housing 15 is contained within a bore 16 in a wall 17 of the case 11. The contact switch 14 also has a springloaded rod 18 contained within the housing 15 which is biased in such a way that the rod head 20 of the rod 18 is normally pushed away from the watch case 11. When actuated by pushing the rod head 20 towards the case 11, the rod portion provides electrical contact between the watch case 11 and a conductive elastomer 21 contained within the watch module 10. The first and second contact switches 12, 13 are similary constructed and perform similar functions. The second contact switch has a recessed rod head 22. The portion of the wall case 11 and the switches 12, 13, 14 as described are intended to depict a typical structure with which the electronic watch module assembly 10 may interface.

Figure 2:
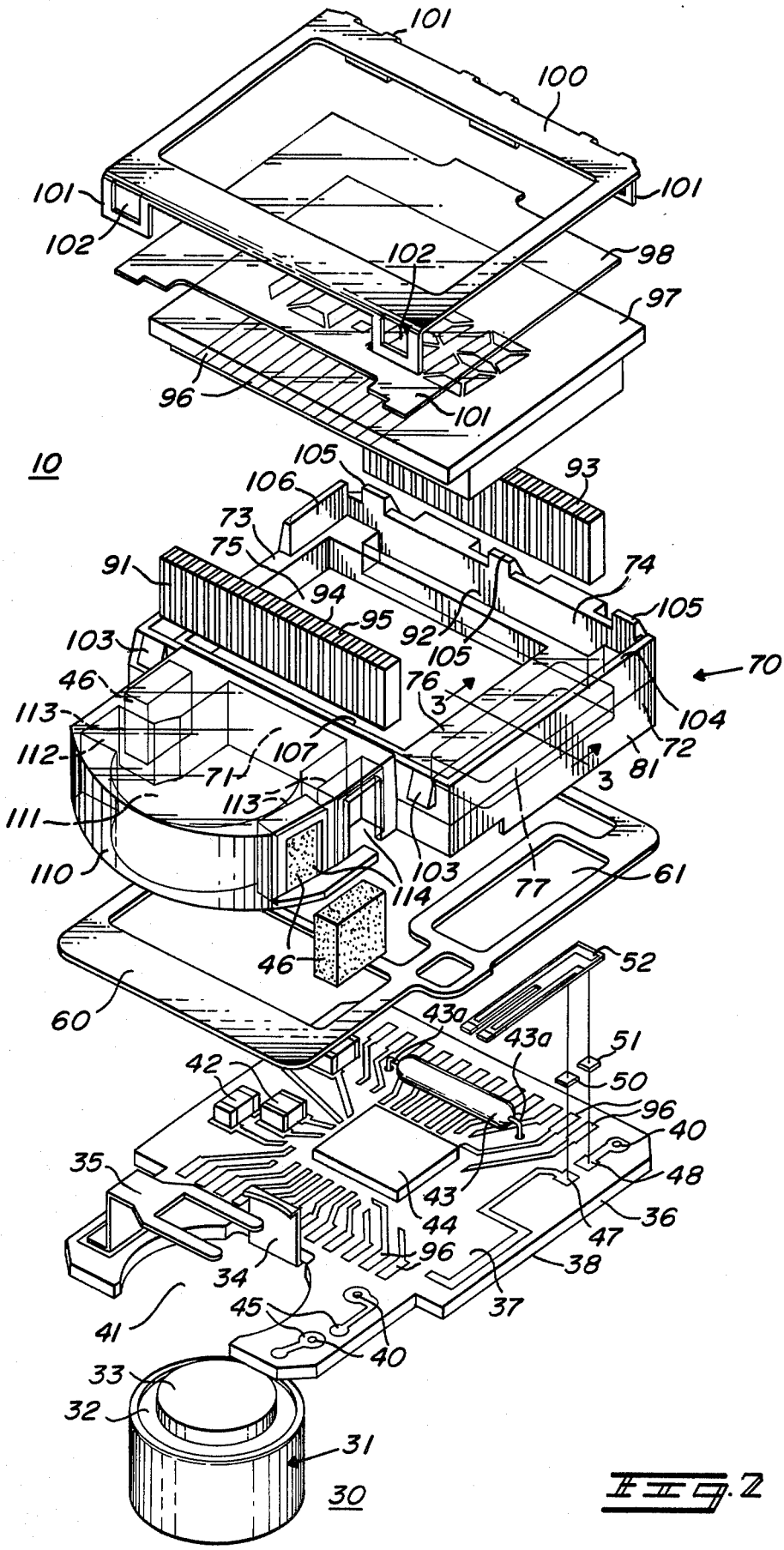
FIG. 2 is an exploded view of the component elements of an electronic watch module of FIG. 1.

Referring to FIG. 2., the electronic watch module assembly 10 is shown in exploded perspective view. A battery 30 is included, having a cylindrical shape and a metallic outer enclosure 31, an insulator portion 32 and a center electrode 33. The metallic outer enclosure 31 is held in contact with a first battery connector clip 34 and the center electrode 33 is held in contact with a second battery connector clip 35. The first battery connector clip 34 and the second battery connector clip 35 are soldered to plated connectors deposited on a flat substrate 36.

The substrate 36 is a ceramic substrate of fired alumina material having a generally rectangular surface area and, in the preferred embodiment, has a thickness of about 25 mils. Conductors of palladium silver and gold material are screened and fired onto the substrate top 37 and the bottom 38 surfaces. Plated-through holes 40 extend through the wafer.

Various electronic watch components are mounted on the substrate. The first and second battery connector clips 34, 35 are soldered to the top surface 37 of the substrate at positions adjacent to an aperture 41 formed in one end of the substrate providing clearance for the battery 30. Capacitors 42 are also attached to the substrate surface as shown. A low voltage incandescent light source 43 for illuminating the watch display is also attached to the substrate by having its leads **34*a* extend through the holes and by being soldered to conductors on the bottom surface 38 of the substrate (not shown). An integrated circuit module 44 is also attached to the top surface and electrical connections are made to various conductors on the top surface by means of gold bonded wires (not shown) in a manner well-known in the art. Conductive pads 45 having plated-through holes 40 are also deposited on the top surface 37 of the subtrate 36 for making contact with elastomer conductors 46**.

Also plated on the top surface 37 of the substrate 36 are a first support pad 47 and a second support pad 48 to which are attached by a conductive epoxy a first crystal support pedestal 50 and a second crystal support pedestal 51, made of conductive material and having a block shape with a top and bottom surface preferrably of about 20 mils square and a height of 8 mils. As will be appreciated, these pedestals 50, 51 provide a very low profile support for a tuning fork piezoelectric crystal 52. The crystal itself has various surfaces plated with metallic conductors and the crystal may be trimmed to frequency by laser removal of portions of the metallic conductors.

An epoxy prefrom 60, as shown in FIG. 2, provides a means by which the ceramic substrate 36 is mounted to a chassis member 70. The preform may be made of an epoxy material such as No. 552 manufactured by Able Stick and contains a plurality of apertures substantially as illustrated. In particular, a first preform aperture 61 is shaped so as to surround the area of the substrate 36 which has mounted to it the tuning fork piezoelectric crystal 52.

The chassis member 70 essentially has an egg-crate configuration. In this regard, see particularly FIG. 4. Chassis member 20 may be fabricated from any suitable material such as polysulfone material manufactured by the Union Carbide Corporation. Polysulfone is a rigid, strong, heat-resistant, transparent thermoplastic material suitable for injection molding.

Chassis member 70 is preferrably molded to its final desired shape and includes a central wall 71 located in a centralized location of the frame, and extending between a right side wall 72 and a left side wall 73. A rear wall 74 is attached to the right side wall 72 and the left side wall 73. These form, together with the central wall 71, a generally rectangular frame structure having walls of thin cross-section which surround a central aperture 75. Chassis member 70 further includes a portion 76 extending inwardly from the right side wall 72 which contains a cavity 77 (best seen in FIG. 4) for housing the tuning fork piezoelectric crystal 52.

In assembling the electronic watch module 10, the substrate 36, having mounted upon it the tuning fork piezoelectric crystal 52, is placed in an appropriate atmosphere containing, for example, 90% nitrogen and 10% hellium which provides optimized operating conditions for the piezoelectric tuning fork crystal element. The epoxy preform 60 is placed between the substrate 36 and the chassis member 70. These components are heated to a temperature sufficient to cure the epoxy preform 60 so that the chassis member 70 and the ceramic substrate 36 are sealed together around the cavity 77, forming a hermetically sealed chamber containing the crystal element in an appropriate atmosphere. Thus, the piezoelectric crystal element 52 is contained within a package configuration integrally formed by the chassis member 70 and the substrate 36.

Figure 3:
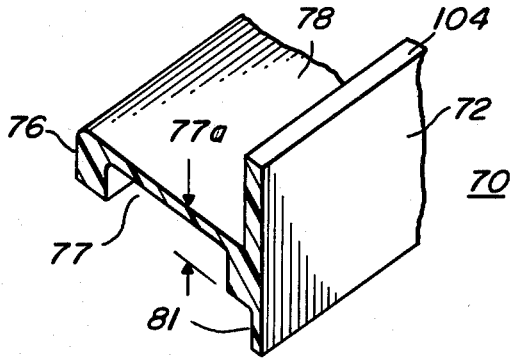
FIG. 3 is a perspective cross-sectional, broken-out view of a portion of the electronic watch module.

FIG. 3 shows on an enlarged scale a sectional, broken-out portion of the chassis member 70 surrounding the cavity 77. The right side wall 72 has extending from it the portion 76. The wall 78 overlying the cavity 77 has a thickness of about 10 mils. A laser beam passes through the wall 78 and trims the assembled oscillator circuit to a predetermined frequency by selective evaporation of conductive material from the surface of the tuning fork crystal element 52.

FIG. 3 also shows the relative heights of the crystal cavity **77*a* in comparison to the wall portions 81 and 104, which are described below. The height of the crystal cavity 77*a*** is typically 40 mils, thereby providing a crystal enclosure having a low profile.

Figure 4:
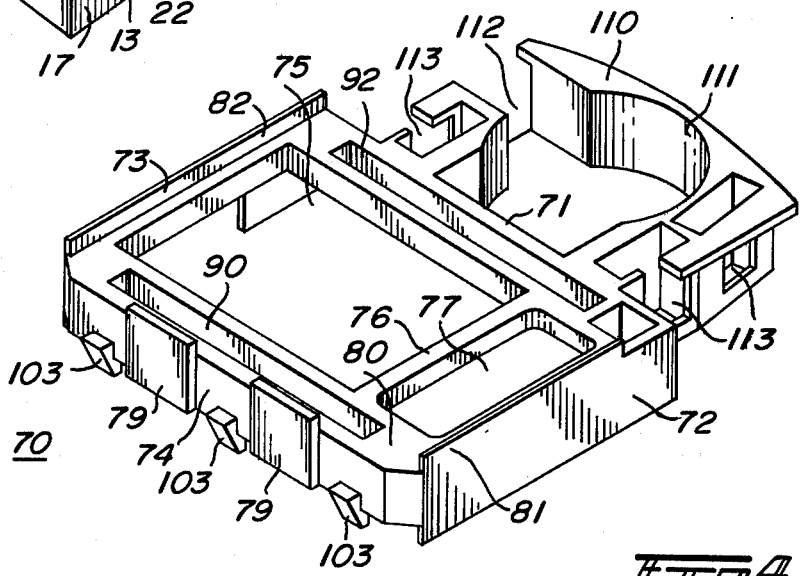
FIG. 4 is a perspective view of a chassis member forming part of the overall assembly.

As shown in FIGS. 2 and 4, the substrate 36 is accommodated within the chassis member 70 by portions 70 of the rear wall 74 projecting above those portions of the chassis member 70 generally defined by a surface 80. A portion 81 of the right side wall 72 and a portion 82 of the left side wall 73 similarly project above the area defined by surface 80 and serve to contain the substrate 36 in a predetermined location with respect to the chassis member 70. A first elongated aperture 92 and a second elongated aperture 90 are formed in the chassis member 70 adjacent to the central wall 71 and to the rear wall 74, respectively. These apertures are designed to contain a first flexible conductor means 91 and a second flexible conductor means 93. The flexible conductor means are formed from a series of alternate conductor 94 and non-conductors 95 (typically shown). These flexible conductor means 91, 93 provide circuit connections between the pads 96 on the top surface 37 of the substrate 36 and conductive pads 96 (typically shown) which are part of a liquid crystal display module 97.

The operation of the liquid crystal display module 97 such as utilized in this invention is well-known in the art, such that extensive and detailed description should not be necessary. Typical characters that may be displayed are shown in FIGS. 1 and 2.

A polarizer sheet 98 is required to be used with the display module 97. Both are contained by a display clip 100 which has downwardly extending tabs 101 containing apertures 102. The tabs 101 are designed to cooperate with and resiliently snap over projections 103 on the outer surfaces of the chassis member 70, thereby retaining the liquid crystal display module 97 and the polarizer 98. A raised portion 104 of the right side wall 72, raised portions 105 of the rear wall 74, raised portions 106 of the left side wall 73, and a raised portion 107 of the central wall 71 project upward from their respective walls, containing and locating the liquid crystal display module 97 and the polarizing sheet 98 in assembled relation.

Also, as shown in FIGS. 2 and 4, the central wall 71 has an outwardly projecting portion 110 which has a central cavity 111 slightly larger than the diameter of the battery 30. Another cavity 112 in an exterior wall of the projecting portion provides clearance for the second battery connector clip 35. The central cavity 111 holds the battery 30 in position with respect to the first battery connector clip 34 and the second battery connector clip 35.

Also contained within the outwardly projecting portion 110 of the central wall 71 are other cavities 113 designed to accommodate conductive elastomers 46. Access to the conductive elastomers 46 is obtained through windows 114 contained in the outside surface of the projecting portion 110. The conductive elastomers 46 are in contact with conductive pads 45 contained on the top surface 37 of the substrate 36. The conductive elastomers cooperate with the contact switches 12, 13, 14 to provide electrical connections between the watch case 11 and various contact pads on the substrate 36.

While a particular embodiment of the invention has been shown and described, it should be understood that the invention is not limited thereto since many modifications may be made. It is therefore contemplated to cover by the present application any and all such modifications that fall within the true spirit and scope of the basic underlying principals disclosed and claimed therein.

We claim:

1. An improved integral watch module assembly comprising:

a chassis member formed in essentially egg-crate configuration having two sides and having upstanding peripheral walls and a central aperture, said chassis member further including a portion extending laterally inwardly from one of said walls between the upstanding extremities thereof and having a cavity therein;

a flat substrate adapted to be contained within said peripheral walls on one of said two sides of said chassis member and said central aperture and carrying electronic watch components and conductors thereon;

a piezoelectric crystal element;

means for mounting said piezoelectric crystal element to said substrate;

means for affixing said substrate to said chassis member so that the substrate and the cavity integrally form a hermetically sealed chamber for said crystal element, and a digital display adapted to be contained within said peripheral walls on the other of said two sides of said chassis member and opposite said substrate.

2. The module assembly of claim 1 wherein the means for mounting the piezoelectric crystal element to the substrate comprises a pair of spaced apart, metallic mounting posts, each post being attached to the crystal element and to the substrate.

3. The module assembly of claim 1 wherein the chassis member includes a second portion extending laterally outwardly from the chassis member and containing cavities therein for respectively holding a battery and conductive elastomers.

4. The module assembly of claim 1 wherein the digital display further comprises:

a liquid crystal display panel having a viewing area;

a polarizer overlying said display panel viewing area; and a display panel retainer clip having a cutout portion overlying said polarizer and said display panel viewing area, said display retainer clip having downwardly extending tabs for snap fit engaging with portions of said chassis member.

5. The module assembly of claim 1 wherein the means for affixing the substrate to the chassis member comprises an epoxy resin.

* * * * *